United States Patent [19]

Braithwaite et al.

[11] Patent Number: 4,552,477

[45] Date of Patent: Nov. 12, 1985

[54] APPARATUS FOR FEEDING A LIQUID TO AN APPLICATOR

[75] Inventors: John D. Braithwaite; Derrick O. King, both of Berkshire; Sidney J. Williams, Surrey, all of England

[73] Assignee: Black & Decker Inc., Newark, Del.

[21] Appl. No.: 194,452

[22] PCT Filed: Aug. 3, 1979

[86] PCT No.: PCT/GB79/00131

§ 371 Date: Apr. 9, 1980

§ 102(e) Date: Apr. 9, 1980

[87] PCT Pub. No.: WO80/00315

PCT Pub. Date: Mar. 6, 1980

[30] Foreign Application Priority Data

Aug. 9, 1978 [GB] United Kingdom ..... 32726/78

[51] Int. Cl.[4] ..... B43K 5/02

[52] U.S. Cl. ..... 401/188 R; 401/190; 401/203; 222/61

[58] Field of Search ..... 401/188, 190, 191, 203–207; 222/61

[56] References Cited

U.S. PATENT DOCUMENTS

| | | | |
|---|---|---|---|
| Re. 29,311 | 7/1977 | Ritter | 401/188 R |
| 753,125 | 2/1904 | Cooper | 401/289 |
| 821,879 | 5/1906 | Meyer et al. | 401/188 R |
| 1,139,353 | 5/1915 | Ellis | 401/188 X |
| 2,504,487 | 4/1950 | Anson | 401/278 |
| 3,020,579 | 2/1962 | O'Connor | 401/188 R |
| 3,134,130 | 5/1964 | Chadwick | 401/188 |
| 3,145,411 | 8/1964 | Fischer et al. | 401/188 R |

(List continued on next page.)

FOREIGN PATENT DOCUMENTS

| | | |
|---|---|---|
| 1449554 | 8/1966 | France . |
| 2006896 | 1/1970 | France . |
| 2109072 | 5/1972 | France . |
| 2216777 | 8/1974 | France . |
| 2301306 | 9/1976 | France . |
| 363312 | 12/1931 | United Kingdom . |
| 470277 | 8/1937 | United Kingdom . |
| 1175986 | 1/1970 | United Kingdom . |
| 1262552 | 2/1972 | United Kingdom . |
| 1293195 | 10/1972 | United Kingdom . |

*Primary Examiner*—Edward M. Coven

*Attorney, Agent, or Firm*—Ronald B. Sherer; Edward D. Murphy; Harold Weinstein

[57] ABSTRACT

A container of paint or other liquid is seated within a pressurized vessel. Both the vessel and the paint container are designed with a special orientation. This assures that only the specially-designed paint container will be received within the pressurized vessel, and discourages the use of a standard commercially-available can of paint. The top of the paint container is closed by a diaphragm. The diaphragm has an annular recess normally closed by a removable plug. When the plug is removed, a delivery pipe sealingly carried by the vessel lid extends through the diaphragm and is received vertically within the paint container. A small opening in the diaphragm assures that the pressure internally and externally of the paint container will be substantially equalized. The delivery pipe is connected to a flexible feed tube, and the end of the feed tube is connected to a hand-held applicator. The applicator carries an on/off switch for interrupting the flow of paint to the applicator. The applicator also carries a regulator for varying the amount of paint flowing through the applicator to the work surface. A replaceable gas cartridge is housed on the lid of the vessel, and pressurizes the vessel through a suitable conduit means. This conduit means includes a pressure regulating means which establishes a high-pressure chamber and a low-pressure chamber between the cartridge and the interior of the vessel. A pressure relief valve is also provided for the vessel. In an alternative arrangement, the paint container is omitted, and the vessel has a partition below which a liquid containing chamber is defined. This partition allows gas to flow therethrough but prevents liquid flow therethrough.

5 Claims, 11 Drawing Figures

U.S. PATENT DOCUMENTS

| | | | |
|---|---|---|---|
| 3,310,831 | 3/1967 | Brinker | 401/219 |
| 3,325,053 | 6/1967 | De Boer et al. | 222/61 X |
| 3,352,457 | 11/1967 | Tracy et al. | 222/61 |
| 3,418,054 | 12/1968 | Kirch | 401/188 |
| 3,429,642 | 2/1969 | Underwood | 401/188 X |
| 3,503,691 | 3/1970 | Kirch | 401/188 R |
| 3,558,010 | 1/1971 | Zenger | 222/61 X |
| 3,602,601 | 8/1971 | Zenger | 401/190 |
| 3,603,694 | 9/1971 | Hamm | 401/150 |
| 3,640,630 | 2/1972 | Walker | 401/188 R |
| 3,676,010 | 7/1972 | Kirch | 401/188 R |
| 3,768,706 | 10/1973 | Hill | 222/325 |
| 3,776,645 | 12/1973 | Walker | 401/188 |
| 3,861,564 | 1/1975 | Loeffler | 222/80 |
| 3,976,221 | 8/1976 | Martin et al. | 222/61 |

APPARATUS FOR FEEDING A LIQUID TO AN APPLICATOR

This invention relates to apparatus for feeding a liquid to an applicator, and in particular, to apparatus primarily intended for painting.

For many years it has been common practice to apply a liquid to a surface using a brush, the brush first being dipped in a reservoir of the liquid and then wiped over the surface to be coated. For relatively large surface areas, rollers rather than brushes are used, the roller also being dipped in a reservoir of the liquid and then rolled across the surface to be coated. As an alternative to the use of a brush or roller, a pad has, in more recent times, sometimes been used: again, the pad is dipped in a reservoir of the liquid and then wiped across the surface of the coated.

The mode of application desribed above is unduly time consuming because of the necessity to dip the applicator (brush, roller or pad), in the liquid at frequent intervals in order to replenish the supply of liquid on the applicators. This is a particular problem when the user is standing on a ladder or a pair of steps which is frequently the case, for example when painting a ceiling. To mitigate this problem it has been proposed in the case of rollers to increase the liquid capacity of the roller by providing it with its own small liquid reservoir; this attempted solution, however, considerably increaes the weight of the roller making it very tiring to use.

From time to time throughout this century it has been proposed to provide the liquid applicator with a connection via a length of tube to a reservoir of liquid and to feed the liquid from the reservoir to the applicator by pressure generated by a pump. This arrangement has the considerable advantage over the conventional arrangements described above that a user does not continually have to replenish the liquid on the applicator nor does the applicator have to be excessively heavy. These proposed pressurized arrangements have not, however, proved satisfactory. If the reservior of liquid and its associated pump is placed on the ground during application of the liquid then a long length of tubing is required between the reservoir and the applicator and this can impede the user. If, on the other hand, the reservoir and pump are carried by the user then this impedes the user during painting and is tiring as a result of the weight of the reservoir and pump assembly.

It is known to dispense a liquid from a container using a small capsule of pressurized gas. For example, soda syphons have been available for some years operating on this principle. National Can Corporation have disclosed a paint apparatus in which a container of paint is pressure fed by pressurized gas from a capsule to a roller; in operation the container is rested on the ground and a long length of tubing connected between the container and the roller to allow a user to paint a surface, holding the roller alone. An illustration of this proposed apparatus appeared on pages 30A and 31A of the Journal of Paint Technology Vol. 40, No. 521, June 1968. Liquid containers pressurized by capsules of gas are also described in U.S. Pat. Nos. 3,352,457 and 3,558,010.

The painting apparatus proposed by the aforesaid patents ('457 and '010) still suffers various drawbacks. The use of a long length of tubing can impede the user as already mentioned and also this apparatus, as well as the pressurized arrangements already described, is difficult to clean and messy to use. If the painting apparatus includes its own pressure vessel for containing the paint, the paint must first be poured into this vessel and then, after painting, any paint left in the vessel must be poured out and the vessel, in addition to all the rest of the apparatus, must be cleaned. The time saved during painting with the apparatus may thus be consumed in extra time spent preparing the apparatus for use and cleaning the apparatus after use.

To some extent, the cleaning operation can be reduced by supplying the paint in its own pressure vessel to which the pressurizing arrangement is then directly attached, since this avoids the need to clean the vessel after use. However, in this case the vessel containing the paint must be specially constructed both to withstand the pressure contained in the vessel during use and to receive the pressurizing arrangement. This greatly increases the cost of the paint vessel over a conventional paint can.

It is an object of the invention to provide an apparatus for feeding a liquid to an applicator, that mitigates at least some of the disadvantages described above.

It is another object of the present invention to provide a portable pressurized liquid applicating system wherein the pressure is supplied by a replaceable gas cartridge, and wherein pressure-reducing means are included in the housing to assure that the liquid is supplied at the proper pressure from a feed conduit to a hand-held applicator.

It is yet another object of the present invention to provie a portable pressurized paint applicating system intended for consumer usage by homeowners and do-it-yourselfers, wherein a container of paint is inserted within a pressurized vessel, the paint container and the pressurized vessel being designed with a special orientation therebetweeen.

The use of a small capsule of liquified or pressurized gas to provide the pressure in the container provides an extremely compact, lightweight and convenient pressurizing arrangement.

It is yet still another object of the present invention to provide a specially-designed paint container which is continually closed by a diaphragm, the diaphragm having a recessed portion normally closed by a removable plug, and the plug being removed prior to insertion of the paint container within the pressurized vessel.

The provision of a container within the vessel is an important feature of the present invention. The liquid to be fed to an applicator can be sold in the container which, since it is, in use, disposed in the outer vessel does not have to be pressure vessel and can be of simple construction. After the liquid has been fed from the container, the latter can be thrown away and the vessel does not have to be cleaned.

The feed conduit may pass through the top of the vessel and the top of the container to a location adjacent the bottom of the container. The feed conduit may pass through the container in such a way that the junction between the container wall and the feed conduit is closed over. This inhibits liquid spilling from the container into the vessel. A small hole may be provided in the top of the container to allow gas to flow between the container and the vessel to equalize the pressure therein. Alternatively a slit may be provided in the top of the container.

The container may also include a closure member which can be secured over the top of the container when the container is not in use to seal the container. This preserves the liquid in the container when it is not in use and prevents spillage.

The pressure reducing means may be adjustable to vary the pressure, in use, in the vessel. The range of pressure variation may be limited.

The pressure reducing means may include a valve member mounted in a passage providing communication between the first fluid path and the second fluid path, the valve member being movable between a first position in which the passage is closed and a second position in which the passage is open, the valve member being resiliently biased, in use, into the first position, and a piston or diaphragm co-operable with the valve member and movable away from one position in which the valve member is held in the second position by the piston or diaphragm to another position in which the valve member assumes its first position, the piston or diaphragm being biased to said one position by a spring and being biased away from said one position to another position by the pressure of gas on the low pressure side of the pressure reducing means.

The bias force of the spring acting on the piston or diaphragm may be adjustable, whereby the pressure of gas required to move the piston or diaphragm away from said one position to another position is adjustable.

In use, a capsule of liquified or pressurized gas is located in the housing. The gas may be carbon dioxide or nitrous oxide or any gas which does not have too substantial a deleterious effect on the liquids with which it will come into contact.

The vessel may comprise a body part and a lid.

The lid may be mounted on the body part of the vessel such that if excess pressure develops between the lid and the body part the vessel is vented between the lid and the body part.

A pipe may be provided through the lid to provide the feed conduit for transferring liquid from the vessel to an applicator.

The pressurizing assembly may be mounted on the lid.

The vessel may be arranged to be carried by a user without using his hands. In this case the user has both hands free to operate the applicator or perform any other function.

A handle may be mounted on the vessel. The handle may be of inverted rectangular 'U' shape.

A clip may be provided on the vessel for attaching the vessel to a belt, to enable a user to suspend the vessel from his waist.

A pressure relief valve may be mounted in a wall of the vessel. The pressure relief valve may be mounted on the lid of the vessel. An actuating arrangement may be provided for actuating the pressure relief valve each time the apparatus is assembled for use. Such an arrangement safeguards against the possibility of the pressure relief valve becoming stuck.

Manually operable means may be provided for venting the pressurized gas in the vessel to return the pressure in the vessel to atmospheric pressure. The venting means may be provided by the pressure reducing means. Alternatively the venting means may be provided by some other arrangement, for example by the pressure relief valve.

In use, an applicator is connected to the feed conduit via a length of flexible tube. The applicator may, for example, be a pad, a roller or a brush. The length of tube is preferably between one and two meters long. The tube must be long enough to allow a user full range of movement of the applicator but excessive length is undesirable as it may impede the user, increases the pressure required to feed the liquid and adds to the length of tube to be cleaned. In a particular example of the invention the tube is one and a quarter meters long. The applicator is preferably provided with a valve for controlling the flow of liquid along the tube.

It is a further object of the present invention to provide a modified pressure vessel having a partition extending across the interior of the vessel and defining a paint containing portion of the vessel beneath the partition.

The partition inhibits liquid reaching other parts the apparatus but allows gas to flow into the liquid containing portion of the vessel. The partition may include a small hole or slit to provide a gas flow path.

The partition may be interposed between the lid and the body of the vessel and provide a seal between the lid and the body. The arrangement may be such that unless the partition is fitted, the lid does not seal on the body. This prevents the apparatus being used without the partition.

A filter may be provided adjacent the end of the feed conduit in the vessel to filter liquid passing into the end of the feed conduit.

The feed conduit may pass out of the vessel through the partition and the lid of the vessel. Alternatively the feed conduit may pass out of the vessel at its bottom end.

In the case where the conduit passes out through the lid of the vessel, a plurality of balls may be provided in a chamber defined by the filter around the end of the feed conduit, the ball having a lower density than the liquid contained, in use, in the vessel and being of a diameter larger than the internal diameter of the bottom end of the feed conduit, the arrangement being such that when, in use, the level of liquid in the vessel approaches the bottom end of the conduit, one of the balls assumes a position overlying the bottom end of the conduit and closes the conduit.

In the case where the conduit passes out of the vessel at its bottom end a float valve member may be provided above the end of the feed conduit and may be arranged for movement between a lower position in which the float valve member covers the end of the feed conduit and an upper position in which the float valve member is spaced from the end of the feed conduit, the arrangement being such that when, in use, the level of liquid in the vessel approaches the entrance to the conduit, the float valve member moves from its upper position to its lower position.

The float valve member and filter may form part of a single assembly. The assembly may be removably seated on the bottom wall of the vessel.

A rod may be attached to the assembly extending upwards to the top of the vessel.

According to another aspect of the invention a method of feeding liquid to an applicator uses an apparatus as defined above.

By way of example, an apparatus for feeding a liquid to an applicator will now be described with reference to the accompanying drawings, in which.

Figure 2:
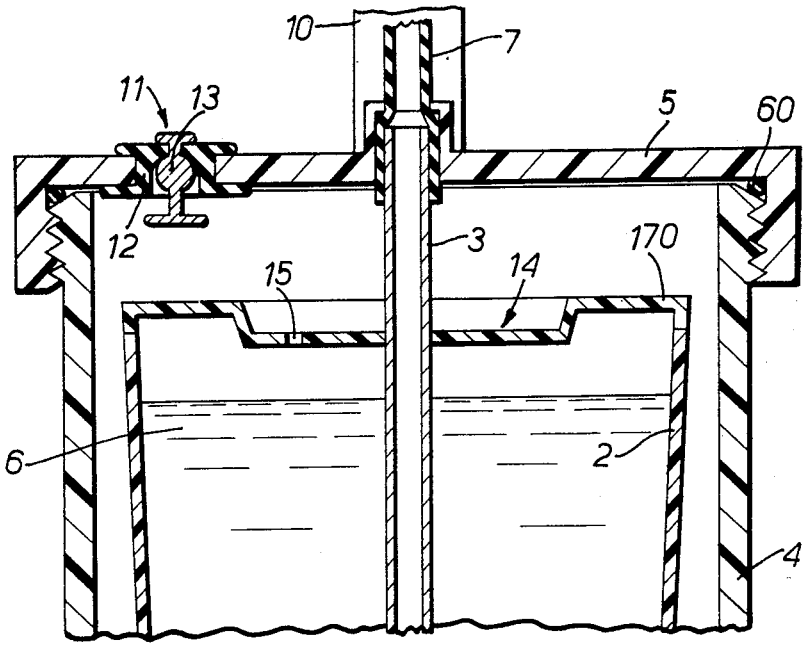
FIG. 2 is a sectional side view of part of the apparatus.
Figure 2A:
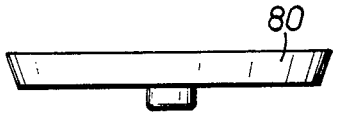
Figure 4:
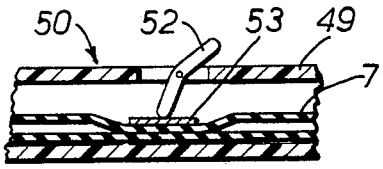
Figure 3:
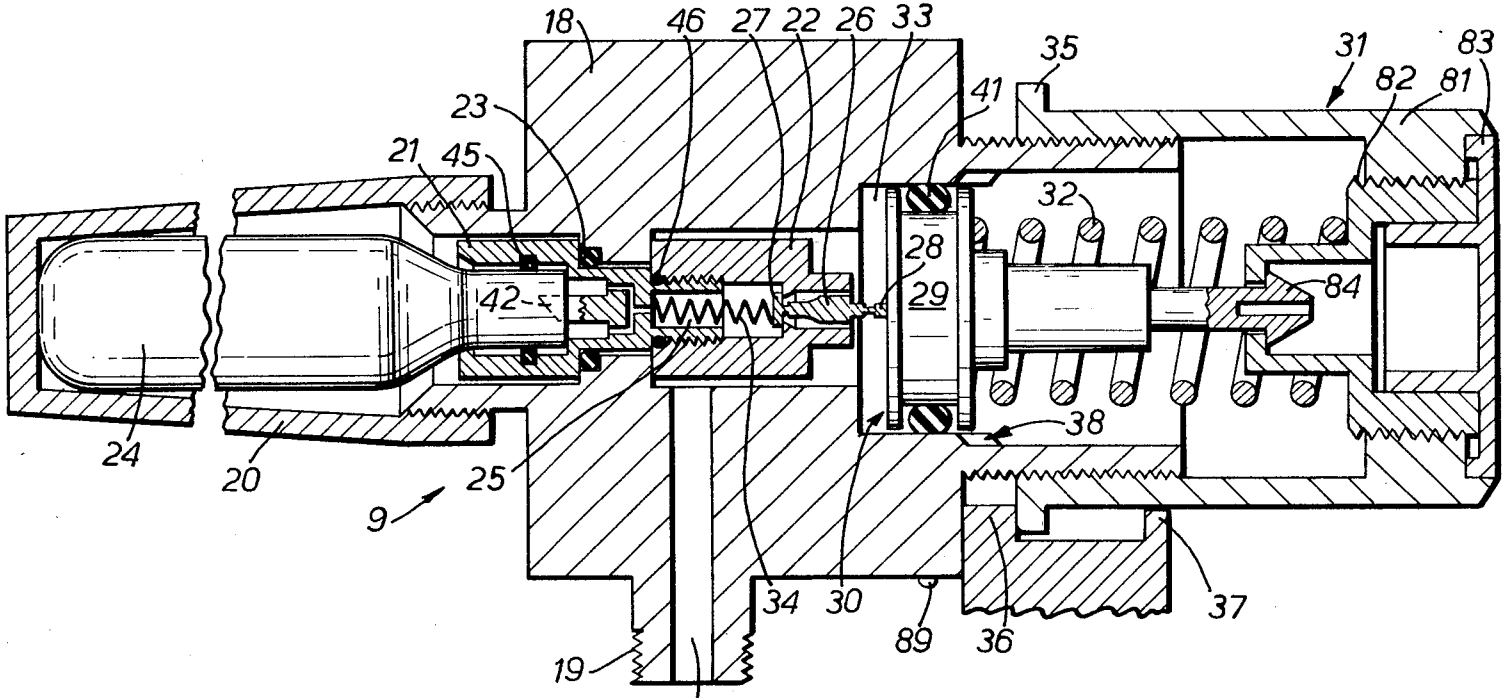
Figure 5:
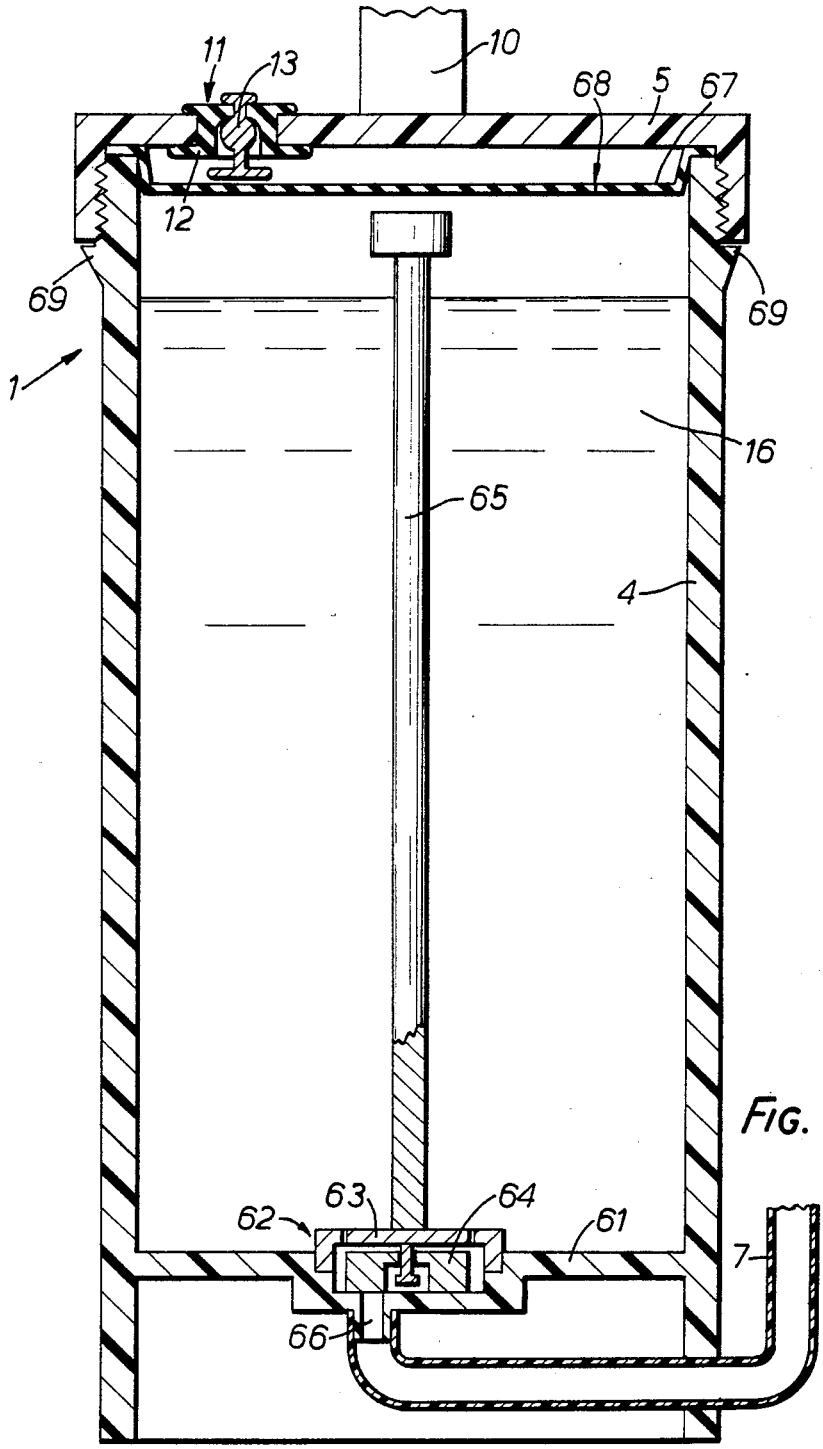
Figure 6:
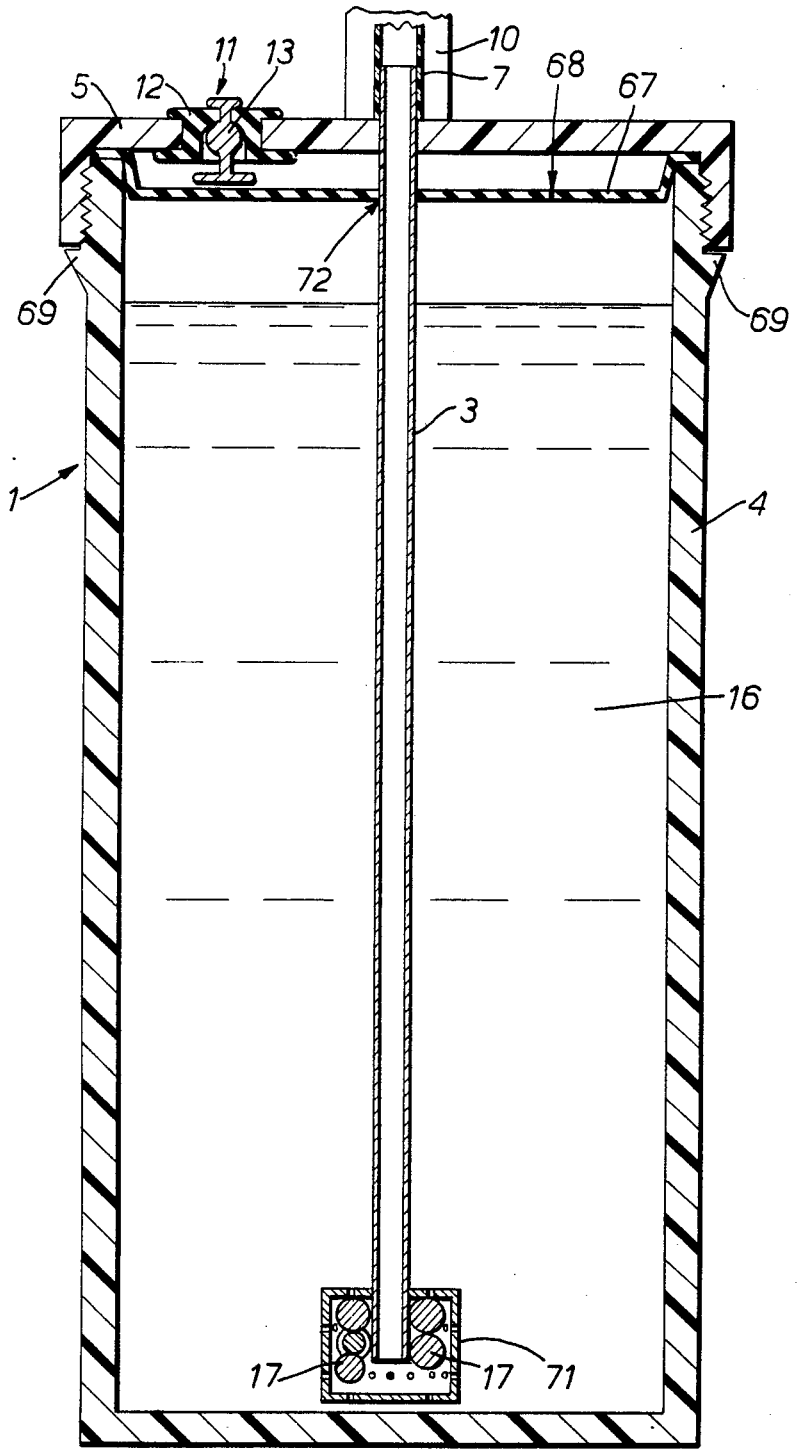
Figure 7:
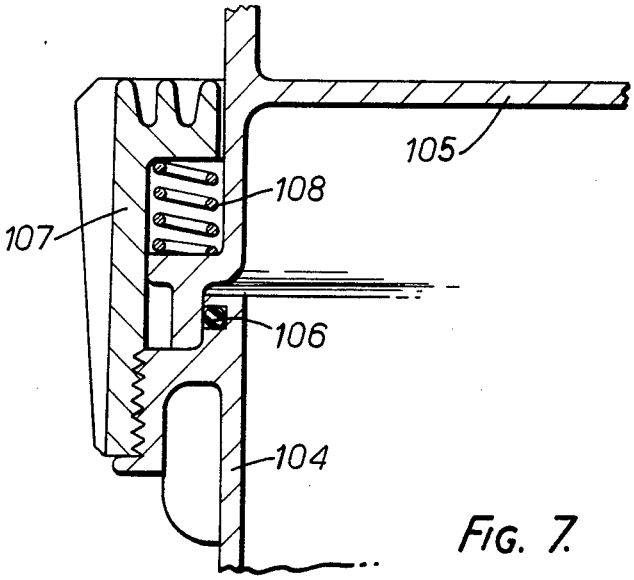
Figure 8:
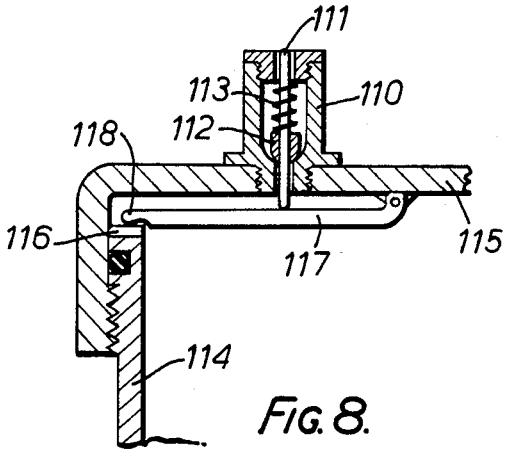
Figure 9:
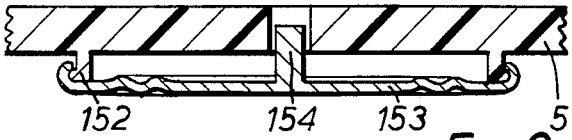
Figure 10:
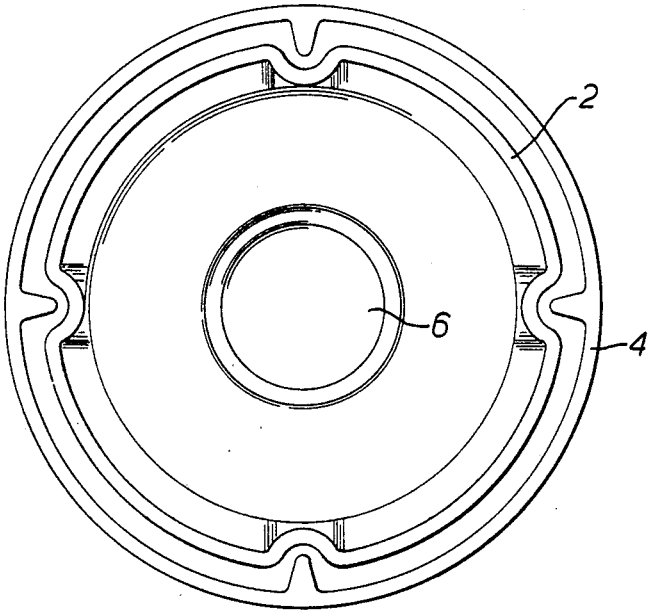

FIG. 2A is a side view of a closure member associated with a component shown in FIG. 2, FIG. 3 is a sectional side view of another part of the apparatus, FIG. 4 is a sectional side view of a switch included in the apparatus, FIG. 5 is a sectional side view illustrating a modified form of the part of the apparatus shown in FIG. 2, FIG. 6 is a sectional side view illustrating another modified form of the part of the apparatus shown in FIG. 2, FIG. 7 is a sectional side view of a small part of the apparatus illustrating a modification which may be made to the apparatus of FIG. 2, FIG. 8 is a sectional side view of another small part of the apparatus illustrating another modification which may be made to the apparatus of FIG. 2, and FIG. 9 is a sectional side view of a pressure indicator which may be incorporated in the apparatus, and FIG. 10 shows the orientation between the paint container and the pressurized vessel.

Figure 1:
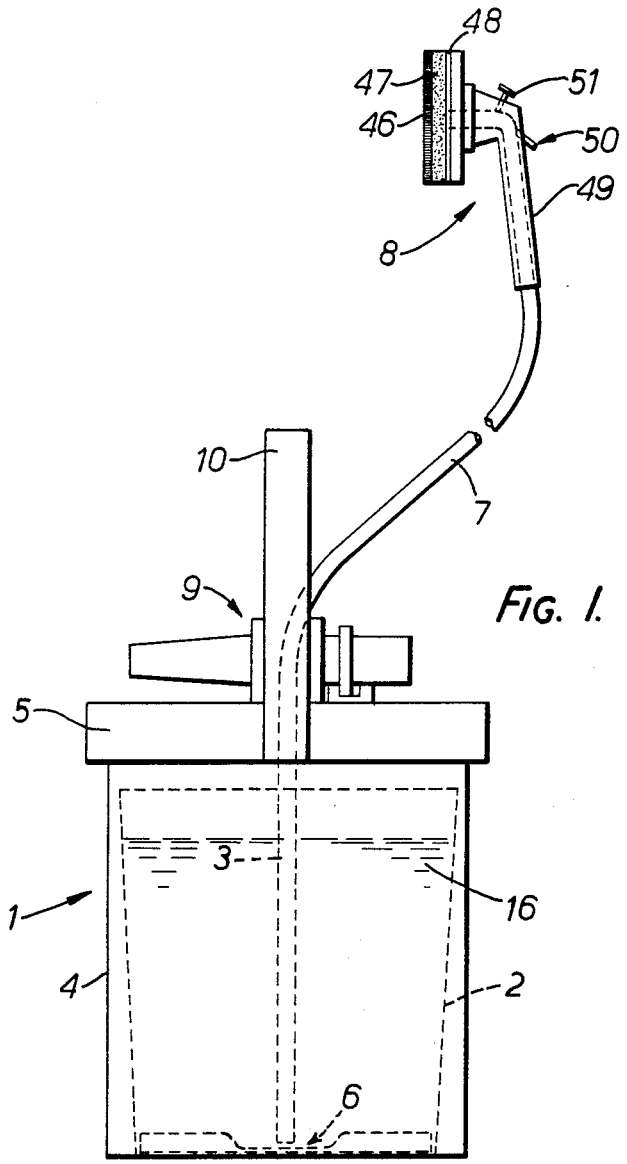
FIG. 1 is a side view of the apparatus.

FIG. 1 shows a vessel 1 of circular cross-section having a body 4 and a lid 5 in which is received a container 2 containing paint 16. The vessel 1 and container 2 are made of a plastics material. A feed conduit for the paint is provided by a pipe 3 extending from the centre of the lid 5 of the vessel, towards the bottom of the container. The container 2 has a well 6 formed in its base and the pipe 3 extends into this well. A flexible tube 7 which is one and a quarter meters long is attached to the end of the pipe 3 and leads to a paint pad 8.

A pressurizing assembly 9 including a capsule or cartridge of liquefied gas and a reduction valve (not shown in FIG. 1) is mounted eccentrically on the lid 5 and pressurizes the vessel 1 and the inside and outside of the container 2. Also mounted on the lid 5 is a safety valve (not shown in FIG. 1) and a handle 10 which has two upright limbs extending from the diametrically opposite parts of the periphery of the lid 5 and an integral cross-member connecting the tops of the upright limbs. Thus, the handle 10 is of inverted rectangular 'U' shape.

Referring now to FIG. 2, which shows the upper portion of the vessel 1 and the container 2 but does not show the pressurizing assembly 9, the lid 5 is screwed onto the body 4 of the vessel and an 'O' ring 60 seals the junction between these parts. The lid 5 has an aperture in which is received a safety valve 11 in the form of a pressure relief valve. The safety valve 11 comprises a grommet 12 and a valve member 13 received in the grommet 12. In its normal unoperated position shown in FIG. 2 the valve member seals the aperture in the lid 5.

The top of the container 2 is defined by a lid 170 permanently fitted to the container 2 and defining a diaphragm 14 which has a central aperture through which the pipe 3 extends as a close fit and a small hole 15 which ensures equalisation of pressure between the inside and outside of the container but which is not sufficiently large to allow paint to pass through the hole except at a very slow rate. The diaphragm 14 is inset from the top of the container defining a recess above the diaphragm which receives a sealing plug SO (FIG. 2A) when the container 2 is not in use to seal the container. While the part 14 is referred to as a "diaphragm", it should be understood that this part may be of rigid construction.

The lid 5 has a central cylindrical recess within which the tube 7 is secured to the pipe 3. To assemble the apparatus the end of the tube 7 is passed through the lid 5 and fitted over the pipe 3. The tube 7 is then pulled back through the lid 5 drawing the end of the pipe 3 into the recess. The assembly of the pipe 3 and tube 7 are a tight fit in the recess and seal the junction of the tube 7 and the lid 5.

Referring now to FIG. 3 which shows the pressurising assembly 9, the assembly has a body 18 including a screw threaded boss 19 which passes through an aperture in the lid 5 of the vessel 1 and to which a nut is secured to retain the assembly 9 on the lid 5. One or more pegs 89 on the base of the body 18 engage in corresponding recesses (not shown) in the top of the lid 5 and locate the assembly 9 on the lid 5. The assembly 9 includes a housing 20 for receiving a capsule 24 of liquid carbon dioxide. A capsule piercing member 21 including a piercer 42 is received in the body 18 and an 'O' ring 23 seals the interface of the piercing member 21 and the body 18. The end of the piercing member 21 adjacent the housing 20 has a bore sized to receive the neck of the capsule 24 and an 'O' ring 45 is seated in the bore to seal the interface of the capsule neck and the bore. To insert a capsule 24 into the assembly 9 the housing 20 is first unscrewed. The capsule 24 is then placed in the housing 20 and the housing 20 brought into position to be screwed onto the body 18. At this stage, the neck of the capsule 24 is in sealing engagement with the piercing member 21 but the capsule is to the left of the position shown in FIG. 3 so that the capsule is not yet pierced. As the housing 29 is now screwed onto the body 18, the housing drives the capsule onto the piercer 42 and the capsule is pierced allowing gas to flow along a fluid path from the capsule through the piercing member 21 into a chamber 25 defined by the piercing member 21 and a valve housing 22 which is screwed onto the piercing member and whose interface with the piercing member is sealed by an '0' ring 46. The chamber 25 is the high pressure chamber of an adjustable pressure reducing valve assembly which will now be described.

The valve housing 22 slidably receives a valve member 26 which has a closure disc 27 at one end which is in the chamber 25 and a head 28 at the other end. The closure disc 27 abuts a seat formed on the housing 22 and is resiliently biased by a weak spring 34 against the seat. The right hand end (as seen in FIG. 3), of the body 18 has a bore 30 in which a piston 29 is slidingly received, an 'O' ring 41 being provided around the piston 29 to seal the interface of the piston 29 and the bore 30. The bore 30 is closed by a cap assembly 31 screwed onto the exterior of the body 18. The piston 29 is inwardly biased by a compression spring 32 extending between the piston and the cap assembly 31. In the position shown in FIG. 3 the head 28 of the valve member 26 abuts the piston 29. A chamber 33 is defined between the valve housing 32 and the piston 29; this chamber communicates with a duct 44 which extends through the boss 19 of the body 18 and thus provides a fluid path between the vessel 1 and the chamber 33.

The cap assembly 31 constists of an operating member 81 screw-threaded on the body 18, an adjusting member 82 screwed into an axial passage of the member 81 so that the relative axial position of the members 81 and 82 can be adjusted by screwing the member 82 into the member 81, and a closure member 83 which fits over the outer end of the axial passage in the member 81 which conceals the adjusting member 82 and also locks the adjusting member 82 to the operating member 81. The spring 32 extends between the piston 29 and the adjusting member 82, and the maximum separation of the piston 29 and the adjusting member 82 is limited by the engagement of an anchor 84 extending from the piston 29 with the adjusting member 82.

Before insertion of the capsule 24, with the pressure in the vessel 1 atmospheric and with the valve set to provide a finite gauge pressure in the vessel 1, the pressure in chamber 33 is atmospheric so that the piston abuts the end face of the bore 30 and the valve member 26 is pressed against the action of the spring 34 to an open position in which the closure disc 27 is spaced from the seat on the valve housing 22. Upon insertion of the capsule 24, pressurized gas passes through the chamber 25 and the chamber 33 into the vessel 1. As the pressure in the chamber 33 then increases to above atmospheric the piston 29 is pressed outwards against the bias of the spring 32 to a position in which the force of the pressure over the face of the piston substantially equals the force of the spring 32 (there is also a force applied to the piston by the spring 34 but this is so small as to be insignificant). The pressure continues to increase until the piston reaches the position shown in FIG. 3 at which stage the closure disc 27 abuts the valve seat of the valve housing 22 and the flow of gas from the capsule stops.

When the pressure in the vessel 1 drops, for example as a result of paint being fed from the container 2, the force exerted by the spring 32 on the piston 29 will overcome the force of the gas pressure and the valve member 26 will be pressed into the open position. Thus the piston 29 and spring 32 regulate the pressure in the vessel 1. During normal operation the operating member 81 is in the postion shown in FIG. 3. The pressure which this produces in the vessel 1 is dependent upon the axial position of the adjusting member 82 and this position is set in the factory to produce the desired pressure and the closure member 83 then positioned over the end of the adjusting member. For example, screwing the adjusting member 82 towards the piston 29 increases the compression of the spring 32 and therefore increases the pressure at which the valve member 26 is moved into the closed position. In order to set the position to which a user screws the operating member 81, a flange 35 is provided around the periphery of the member 81 and this flange engages a projection 36 on the lid 5 of the vessel 1 when the member 81 is screwed to the pressurized position.

Another projection 37 is provided on the lid 5 and engagement of the flange 35 with this projection 37 limits the outward movement of the member 81 and prevents the cap assembly being removed after the pressurizing assembly 9 is mounted on the lid 5.

In the event of the valve member 26 becoming stuck in the open position, the pressure on the piston 29 gradually increases and the piston is moved outwards against the bias of the spring 32. The bore 30 however is grooved at 38 so that once the piston reaches the ends of the grooves compressed gas can pass around the side of the piston and out to atmosphere through another groove provided along the screw threads of the member 81 and the body 18. As an alternative to providing the groove, the member 81 may be apertured.

When the operating member 81 is unscrewed so that the flange 35 abuts the projection 37, the head 84 extending from the piston 29 is compelled, by engagement with the adjusting member 82, to move outwardly. Thus even if the piston is inclined to stick, once the member 81 is unscrewed, the piston 29 will be in its outward venting position.

In the event of both the valve member 26 and the piston 29 becoming stuck there is still the safety valve member 13 in the top of the vessel 1 to stop excess pressure developing. Still another safety arrangement (not shown) may be provided by deliberately weakening a portion of the vessel 1 so that this portion of the vessel bursts in a controlled manner when the pressure exceeds a predetermined level; alternatively the vessel body 4 may be formed such that upon excess pressure developing, it distorts destroying the seal between the vessel body 4 and the lid 5.

Referring again to FIG. 1, the paint pad 8 is in some respects similar to a conventionl pad in that it has an outer layer of material 46 supported on a foam backing layer 47 which has a closed cell structure so that it does not absorb the paint; the foam backing layer is in turn attached to a metal backing plate 48. Unlike conventional paint pads, however, the metal backing plate has a central aperture at which the flexible tube 7 terminates and the foam backing layer 47 contains a series of passages extending outwardly from the central aperture and terminating within the layer 46 at a plurality of locations distributed over the pad.

The flexible tube 7 passes through the handle 49 of the paint pad 8 and an on/off switch or valve 50 and a regulating screw 51 are provided on the handle 49.

The on/off switch 50 is shown in FIG. 4 and comprises a switch member 52 pivotally mounted intermediate its ends on the handle 49. One end of the switch member 52 presses via a small plate 53 on the tube 7 and the other end is used to operate the switch. In the position shown in FIG. 4 the switch is in the "off" position and the tube 7 is squeezed flat. If a user now pivots the switch member 52 anticlockwise (as seen in FIG. 4), the member 52 passes through a dead centre position and then allows the tube 7 to return through its own resilience to a circular cross-section. The plate 53 reduces the frictional force opposing movement of the tube 7 and reduces wear on the tube.

The rate of flow of paint through the tube 7 can be controlled by the regulating screw 51. Screwing in the screw 51 restricts the internal cross-sectional area of the tube 7 by flattening the tube. In the innermost position of the screw 51 the tube may be completely closed.

The operation of the apparatus shown in FIGS. 1 to 4 will now be described.

Paint is supplied to a user in the container 2 with the plug 80 sealing over the diaphragm 14. The user removes the plug 80 and places the container 2 in the vessel 1 and screws the lid 5 onto the vessel 1 at the same time inserting the pipe 3 which is secured to the lid 5 into the central aperature in the diaphragm 14. The user then ensures that the switch 50 on the paint pad is in the "off" position and inserts a capsule 24 into the assembly 9 as already discribed. The vessel 1 may be carried in the hand by the handle 10 but preferably the handle 10 is suspended from a belt passed around the waist of the user since this is less tiring and also leaves the user with a free hand. The handle 10 may be provided with a clip (not shown) for attaching the vessel 1 to a belt. The vessel 1 is pressurized by screwing in the cap assembly 31.

The user adjusts the rate of flow of paint with the regulating screw or regulator 51 and is then able to paint without interruption. The switch 50 enables the user to start and stop painting at will.

In the particular example described the container 2 has a capacity of one liter which is sufficient to paint about twelve square meters of a surface and the capsule holds four liters of gas (at atmospheric pressure). The pressure in the vessel 1 is normally regulated to be in the range of between ten and twenty pounds per square inch above atmosphere while the pressure in the capsule is of the order of 700 to 900 pounds per square inch. One capsule contains more than sufficient gas to discharge all the paint from a container.

In order to recharge the vessel 1 with a new paint container the cap assembly 31 is unscrewed to the limit of its movement; this causes the valve member 26 to close (if it is not already closed) and compressed gas in the vessel 1 moves the piston 29 outwards and escapes to atmosphere around the edge of the piston. Even if the piston 29 tends to stick it is positively pulled outwards by engagement of the head 84 with the adjusting member 82. The lid 5 can then be unscrewed, since the vessel 1 must be at ambient pressure, the pipe 3 withdrawn from the container 2, the container removed from the vessel 1, and a new container inserted as described above. As the pipe 3 is withdrawn through the diaphragm 14, paint on the outside of the pipe is wiped off the pipe.

It is helpful for the user to have some indication that the vessel 1 is pressurized and for this purpose a pressure indicator as shown in FIG. 9 may be provided. The indicator is mounted on the vessel lid 5 which is formed with an inwardly extending circular rib 152 over which a flexible diaphragm 153 is fitted. The upper face of the diaphragm 153 carries a projection 154 which is accommodated in a hole in the lid 5. When the vessel is not pressurized the diaphragm 153 is not flexed and the top of the projection 154 is below the upper surface of the lid 5. Upon pressurisation of the vessel, however, the diaphragm 153 flexes and the projection 154 protrudes from the lid 5; the projection 154 is preferably in a colour contrasting with the lid 5 so that it can be easily seen.

After use the apparatus is cleaned. Only the pipe 3, tube 7 and paint pad 8, however, require to be cleaned since the other parts of the apparatus do not come into contact with the paint. Even if the vessel 1 is inadvertently knocked over during use, the diaphragm 14 retains the paint in the container 2 so that the vessel 1 does not need cleaning. Since both the switch 50 and regulator 51 act externally on the tube 7 they do not become contaminated with paint. The paint pad 8 is dismantleable to facilitate cleaning.

The 'O' ring seals are made of a material which is not affected by the fluid to which they are exposed in use.

Conveniently the vessel 1, the flexible tube 7, the assembly 9, the handle 10, and the paint pad 8 are made of plastics materials. For water based paint the container 2 is preferably made of a plastics material but, since plastics materials are attacked by solvent based paints (for example gloss paints) over an extended period of time, the container 2 is preferably made of metal if it is to contain solvent based paints. The container 2 may be made in various other forms. For example the container may be made of cardboard with a metal foil liner.

It may be desirable to provide means to prevent the insertion in the vessel of an unsuitable container, that is one containing a paint of inferior grade or a grade different to the paint which the apparatus is primarily intended to feed. Such means may, for example, take the form of one or more interengaging ribs and grooves or other formations on the external surface of the container and the inner surface of the vessel, or of suitably shaping the interior contour of the vessel to inhibit the insertion therein of a container which has other than a matching shape.

If desired a multiplicity of balls may be provided on the surface of the paint 16, the balls each being of a diameter slightly bigger than the internal diameter of the pipe 3 and having a density very slightly lower than that of the paint so that they float with nearly all of the ball below the paint surface. A sufficient number of balls are provided such that there are two layers of balls across the entire surface of the paint. As the level of paint in the container 2 drops to a low level the lower layer of balls approach the bottom of the pipe 3; finally when the paint level is almost down to the level of the bottom of the pipe 3 the lower layer of balls reach the level of the bottom of the pipe 3 and one of the balls becomes located over the end of the pipe 3 preventing further flow of liquid. This automatic interruption of the paint flow when the container 2 is almost empty ensures that gas does not enter the pipe 3; if gas were allowed to enter the pipe 3 this could result in sputtering of the paint from the pad 8.

FIG. 5 shows a modified form of vessel in which the flexible tube 7 connected to the paint pad 8 is connected at the bottom of the vessel 1 rather than the top and the paint 16 is contained in the vessel itself rather than an inner container. In FIG. 5 parts corresponding to those illustrated in FIGS. 1 or 2 are designated by the same reference numerals even though they may not be identical to those parts.

The vessel shown in FIG. 5 is elongate having a height which is almost twice its diameter. The vessel body 4 has a transverse bottom wall 61 which has a central cylindrical recess 62 in which an assembly comprising a filter 63, a float valve member 64 and a rod 64 is removably seated. At one side of the recess 62 a passage 66 is provided terminating in an outlet to which the tube 7 is attached. The tube 7 passes under the wall 61 and through an aperture in the vessel body 4.

The filter 63 is fixed to the rod 65 while the float valve member 64 is slidably mounted on the rod 65. During normal use the valve member 64 which is of a lower density than the paint remains clear of the opening to the passage 66 but when the vessel is almost empty the member 64 drops into a position covering and closing off the passage 66. This dropped position is the position shown in FIG. 5.

A partition in the form of a diaphragm 67 is removably fitted on the rim of the vessel body 4 and is sandwiched between the rim and the lid 5 sealing the junction of these parts. The diaphragm 67 has a slit 68 which enables gas from the pressurizing assembly 9 (not shown in FIG. 5) to pass through the diaphragm and pressurize the paint 16.

A number of projections 69 are provided around the periphery of the vessel body 4. The projections are located immediately below the lid 5 when the lid 5 is screwed fully onto the body 4 with the diaphragm 67 in place. If the diaphragm 67 is not in place the projections 69 prevent the lid being fully tightened, the vessel is not sealed and the apparatus cannot be used. Thus inadvertent use of the vessel without the diaphragm in place is not possible.

In order to fill the vessel shown in FIG. 5 with paint, the lid 5 is unscrewed and the diaphragm 67 removed. Paint is then poured into the vessel 1, ensuring that the rod 65, filter 63 and member 64 are in place, the diaphragm is pressed over the rim of the vessel body 4 and the lid 5 screwed on. The vessel is then pressurized in the same manner as described with reference to FIGS. 1 to 4 and the apparatus is used also in the same manner as described with reference to FIGS. 1 to 4. The filter 63 is provided to prevent clogging of the tube 7 or the paint pad 8 from any foreign bodies or pieces of paint skin that may be in the paint. Such a filter is not necessary in the apparatus shown in FIGS. 1 and 2 since the paint in the container 1 has not been exposed since being bottled by the manufacturer. It will be understood that the float member 64 serves the same function as the balls, if they are provided, in the apparatus of FIG. 2 and prevents sputtering of paint when the container is nearly empty.

After painting, the lid 5 and diaphragm 67 are removed and any paint left poured back into its original container, the rod 65 being held by the user at the top to prevent it falling out. Provided the vessel has not been tipped over the top of the rod 65 should be free of paint.

The rod 65, filter 63 and member 64 can be lifted out of the vessel 1 to facilitate cleaning.

FIG. 6 shows another modified form of vessel in which the paint 16 is contained in the vessel itself as in FIG. 5 but the flexible tube 7 is connected at the top of the vessel as in FIGS. 1 and 2. In FIG. 6, parts corresponding to those illustrated in FIGS. 1, 2 or 5 are designated by the same reference numerals even though they may not be identical to those parts.

A filter 71 of closed cylindrical shape is press fitted to the base of the tube 3. Inside the filter 71 are a plurality of balls 17 which serve the same function as the balls, if they are provided, in the apparatus of FIG. 2.

The diaphragm 67 is the same as that shown in FIG. 5 except that it has a central aperture 72 through which the pipe 3 passes as a close fit.

In order to fill the vessel shown in FIG. 6 with paint, the lid 5 is first unscrewed and removed. Removing the lid 5 also removes the pipe 3 and filter 71 and since the diaphragm 67 is a close fit around the pipe 3, the diaphragm is also removed. The vessel 1 is then filled with paint and the lid 5, pipe 3, filter 71 and diaphragm 67 replaced. The vessel is then pressurized and the apparatus used in the same manner as described with reference to FIGS. 1 to 4. The filter 71 and the diaphragm 67 can be removed from the pipe 3 to facilitate cleaning.

In the drawings the pressure vessel 1 is shown with square corners and straight sides. In accordance with well known design procedure for such vessels, however, the corners are preferably rounded off and the sides bowed outwardly.

After use of any of the forms of apparatus described above, the apparatus may be cleaned by pumping a solvent, which in the case of water based paints may be water, through the apparatus using the pressure of the capsule of carbon dioxide.

When using the vessel shown in FIG. 6 a user may if he prefers place a small open tin of paint in the vessel 1 instead of pouring the paint into the vessel. This avoids cleaning of the vessel 1 after use.

In the illustrated apparatus a paint pad is attached to the free end of the tube 7. However, a paint brush or roller may alternatively be attached, these devices having an on/off switch and a regulator similar to the paint pad. When using a brush, the flow of paint may be required to be somwhat slower and this can be achieved by appropriate adjustment of the regulator on the brush handle. If desired the applicator may be of a modular construction consisting of a handle incorporating the on/off switch and the regulator and a plurality of heads including at least one pad, roller and brush which can be attached to the handle. The on/off switch and the regulator may be combined into a single control if desired. For the sake of simplicity the regulator may be omitted.

A shoulder strap may be attached to the vessel 1 to allow a user to carry the vessel over his shoulder or any other arrangement may be provided to enable a user to carry the vessel.

The lid 5 may be clamped onto the body 4 of the vessel 1 by a plurality of toggle clamps, instead of screwing the lid onto the body. This has the advantage that the 'O' ring or diaphragm is not subjected to a rubbing action upon tightening of the lid 5. Furthermore the toggle clamps can be spring biased into their closed position in such a way that if the pressure in the vessel exceeds a predetermined level at least one of the toggle clamps is forced open and the lid 5 lifts off the vessel body 4.

A particular example of a lifting lid assembly is shown in FIG. 7. In this figure, the vessel body 104 is shown with a lifting lid 105, an O ring seal 106 being provided between portions of the walls 104 and 105 which with the vessel 1 overlapping are unpressurized. The lid 105 is retained on the body 104 by a ring clamp 107 screwed onto the body 104 and a number of springs 108 are provided around the periphery of the lid 105 between the lid 105 and the ring clamp 107. In the position shown in FIG. 7, the vessel is unpressurized, the lid 105 rests on top of the body 104 and the springs 108 are substantially unstressed.

As the vessel 1 is pressurized the lid 105 lifts off the body 104 and the springs 108 become stressed. Under normal operating pressure portions of the walls 104 and 105 continue to overlap and the 'O' ring 106 seals the interface therebetween. Upon excess pressure developing, however, the springs 108 are further compressed and the lid 105 is lifted clear of the 'O' ring 106 venting the vessel.

In the arrangement shown in FIG. 2 the diaphragm 14 has a hole 15 which ensures equalisation of pressure between the opposite sides of the diaphragm. In place of the aperture, a slit may be provided in the diaphragm, extending for example radially from the central aperture in the diaphragm.

Alternatively it may be possible to omit both the pin hole and the slit and rely on the diaphragm flexing in the region of its central aperture to allow the passage of gas between the diaphragm 14 and the pipe 3. Similarly although the diaphragm in FIG. 5 is shown having a slit, this may be replaced by a pin hole aperture and the diaphragm in FIG. 6 may have a pin hole aperture instead of a slit or alternatively it may be possible to omit both the pin hole aperture and the slit.

The diaphragm 14 may, if desired, initially be without the central aperture. In this case the pipe 3 is provided with a pointed end and is sufficiently stiff to puncture the diaphragm when it is first pressed through the diaphragm. It may be advantageous to neck the pipe where it engages the diaphragm. This may be advantageous if an anti-sputter arrangement of a kind which will now be described is employed in the apparatus shown in FIG. 2. The anti-sputter arrangement consists of providing a compression spring under the container 2 so that as the container 2 empties of paint it becomes lighter and is lifted up relative to the vessel 1, and, when the container 2 is virtually empty of paint, the end of the pipe 3 bears against the bottom of the container 2 sealing over the pipe 3. If desired a resilient member for example a closed cell foam may be provided on the bottom of the container 2 under the pipe 3 to ensure that a good seal is obtained between the pipe and the container.

Necking the pipe 3 where it passes through the diaphragm ensures that there is very little resistance to relative motion of the container 2 and the pipe 3 and also allows free flow of gas into the container. When the pipe 3 is withdrawn from the container 2 after use the lower unnecked portion of the pipe is wiped clean as it passes through the diaphragm.

In the pressure reducing valve assembly shown in FIG. 3 a piston 29 is used. As an alternative a diaphragm connected to the wall of the bore 30 and spring biased in the same manner as the piston 29 could be used. In this case it may not be possible for gas pressure to be vented through the cap 31. An alternative way of venting the gas may be to open the safety valve. The spring 34 which biases the valve member 26 into its closed position may be omitted since gas pressure from the capsule 24 can be used to perform this biasing function.

The housing 20 of the pressure reducing valve assembly 9 may be provided with external radially projecting fins to facilitate screwing and unscrewing of the housing 20. Also the capsule 24 may be located in the housing 20 in such a way than when the housing is unscrewed the capsule 24 is automatically withdrawn from the piercer 42 and comes away with the housing from which it is then removed.

The safety valve assembly may be modified in such a way that every time the lid 5 is secured to the vessel body 4 the safety valve is tested. An arrangement of this kind is shown in FIG. 8. In this arrangement the safety valve assembly consists of a housing 110 in which a valve member 111 carrying a closure member 112 is mounted. A spring 113 biases the closure member 112 onto a spherical seat formed at the bottom of the housing 110. Upon excess pressure developing the closure member 112 is lifted off its seat venting the vessel. The interface of the vessel body 114 and screw-on lid 115 is around the outside of the body and is sealed by an 'O' ring. On one portion of the top of the vessel body 114 a ramp shaped cam surface 116 is provided. A lever 117 is pivotally mounted on the lid 115 at one end and has a cam follower 118 on the other engaging the top of the vessel body 114. Intermediate the ends of the lever 117, the lever touches or is spaced just underneath the lower end of the valve member 111. As the lid 115 is screwed onto the body 114, the lever 117 engages the cam surface 116 once in each revolution of the lid and this engagement raises the lever 117 lifting the valve member 111 into its vented position. When the lid is fully screwed on, the cam surface 116 is arranged to be spaced circumferentially from the cam follower 118 so that the safety valve assembly is closed.

Although the apparatus has been described with reference to the application of paint, it can be used to apply other liquids to a surface. For example it can be used to apply preservative to a wooden surface or for washing surfaces. The apparatus can also be used to feed liquids to other kinds of applicators, for example to a spray head. With a spray head, the apparatus can be used as a garden spray apparatus.

We claim:

1. A portable apparatus for feeding liquid under pressure to an applicator, comprising:

a vessel;

a liquid container received, in use, within the vessel;

a pressurizing assembly supported on the vessel and including a housing having a capsule of pressurized gas and further having pressure reducing means therein, the pressure reducing means having a high pressure side and a low pressure side;

a first fluid path extending from the high pressure side of the pressure reducing means and communicating with the outlet of the pressurized gas capsule;

a second fluid path extending from the low pressure side of the pressure reducing means through the vessel and into the container;

a feed conduit for transferring liquid from the container to an applicator;

the feed conduit passing through the top of the vessel and the top of the container to a location adjacent the bottom of the container; and the portion of the top of the container through which the feed conduit passes being in the form of a diaphragm, the diaphragm closing over the junction between the container wall and the feed conduit.

2. An apparatus according to claim 1, in which a small opening is provided in the diaphragm for the equalization of pressure across the diaphragm.

3. An apparatus according to claim 1, in which the container includes a closure member which can be secured over the diaphragm when the container is not in use to seal the container.

4. A portable apparatus for feeding liquid under pressure to an applicator, comprising:

a vessel comprising a body part and a lid;

a liquid container received, in use, within the vessel;

a pressurizing assembly supported on the vessel and including a housing having a capsule of pressurized gas and further having pressure reducing means therein, the pressure reducing means having a high pressure side and a low pressure side;

a first fluid path extending from the high pressure side of the pressure reducing means and communicating with the outlet of the pressurized gas capsule;

a second fluid path extending from the low pressure side of the pressure reducing means through the vessel and into the container;

a feed conduit for transferring liquid from the container to an applicator; and the lid being mounted on the body part of the vessel such that if excess pressure develops between the lid and the body part the vessel is vented between the lid and the body part.

5. A portable apparatus for feeding liquid under pressure to an applicator, comprising:

a vessel;

a liquid container received, in use, within the vessel;

a pressurizing assembly supported on the vessel and including a housing having a capsule of pressurized gas and further having pressure reducing means therein, the pressure reducing means having a high pressure side and a low pressure side;

a first fluid path extending from the high pressure side of the pressure reducing means and communicating with the outlet of the pressurized gas capsule;

a second fluid path extending from the low pressure side of the pressure reducing means through the vessel and into the container;

a feed conduit for transferring liquid from the container to an applicator;

a pressure relief valve mounted in a wall of the vessel; and an actuating arrangement for actuating the pressure relief valve each time the apparatus is assembled for use.

* * * * *

UNITED STATES PATENT AND TRADEMARK OFFICE

CERTIFICATE OF CORRECTION

PATENT NO. : 4,552,477

DATED : November 12, 1985

INVENTOR(S) : John D. Braithwaite, et al.

It is certified that error appears in the above-identified patent and that said Letters Patent is hereby corrected as shown below:

The term of this patent subsequent to December 27, 2000, has been disclaimed.

Signed and Sealed this

Twenty-ninth Day of November, 1988

*Attest:*

DONALD J. QUIGG

*Attesting Officer*

*Commissioner of Patents and Trademarks*